US008789403B2

(12) United States Patent
Egerton et al.

(10) Patent No.: US 8,789,403 B2
(45) Date of Patent: Jul. 29, 2014

(54) BODYMAKER

(75) Inventors: Daniel Egerton, Skipton Yorkshire (GB); William Woulds, Shipley Yorkshire (GB); Ian Scholey, Barnsley Yorkshire (GB)

(73) Assignee: Crown Packaging Technology, Inc., Alsip, IL (US)

( * ) Notice: Subject to any disclaimer, the term of this patent is extended or adjusted under 35 U.S.C. 154(b) by 305 days.

(21) Appl. No.: 12/745,999

(22) PCT Filed: Nov. 17, 2008

(86) PCT No.: PCT/EP2008/065681

§ 371 (c)(1), (2), (4) Date: Aug. 5, 2010

(87) PCT Pub. No.: WO2009/071434

PCT Pub. Date: Jun. 11, 2009

(65) Prior Publication Data

US 2010/0296897 A1 Nov. 25, 2010

(30) Foreign Application Priority Data

Dec. 6, 2007 (EP) ..... 07122465

(51) Int. Cl.

| | |
|---|---|
| ***B21D 22/28*** | (2006.01) |
| ***B21J 9/18*** | (2006.01) |
| ***B21D 51/26*** | (2006.01) |
| ***B21D 22/30*** | (2006.01) |

(52) U.S. Cl.

CPC ..... *B21D 51/26* (2013.01); *B21D 22/30* (2013.01)

USPC ..... 72/347; 72/450

(58) Field of Classification Search

CPC ..... B30B 1/263

USPC ..... 72/347–349, 450, 451, 456; 413/69; 100/282, 283

See application file for complete search history.

(56) References Cited

U.S. PATENT DOCUMENTS

| | | | | |
|---|---|---|---|---|
| 4,976,131 | A | 12/1990 | Grims et al. | |
| 5,546,785 | A * | 8/1996 | Platt et al. | 72/450 |
| 7,062,949 | B1 | 6/2006 | Haulsee | |

FOREIGN PATENT DOCUMENTS

| | | |
|---|---|---|
| GB | 1359010 | 7/1974 |
| GB | 2274417 | 7/1994 |
| JP | 11 156598 | 6/1999 |

* cited by examiner

*Primary Examiner* — Debra Sullivan

(74) *Attorney, Agent, or Firm* — Baker & Hostetler LLP

(57) ABSTRACT

A can bodymaker and a method of forming different sizes of drawn and wall ironed cans from the same bodymaker, in which the bodymaker includes a ram (4), a crank (22), first and second connecting rods (21, 23) and a swing lever (20) connecting the crankshaft (22) to the ram (4). Different locking positions (X, Z) are provided on the swing lever so that the first (primary) connecting rod is connected to alternative positions on the swing lever. The primary connecting rod (21) then rotates about an axis between the selected locking position and position (Y) of pivot pin 30 on the swing lever (20). The primary connecting rod drives the swing lever to rotate by a corresponding degree, and thereby converts the swing lever rotation into axial movement of the ram (4) so as to move the ram by a specific stroke length. By altering the locking pin (25) position and therefore the pivot point for the primary connecting rod, the stroke of the ram is changed.

14 Claims, 7 Drawing Sheets

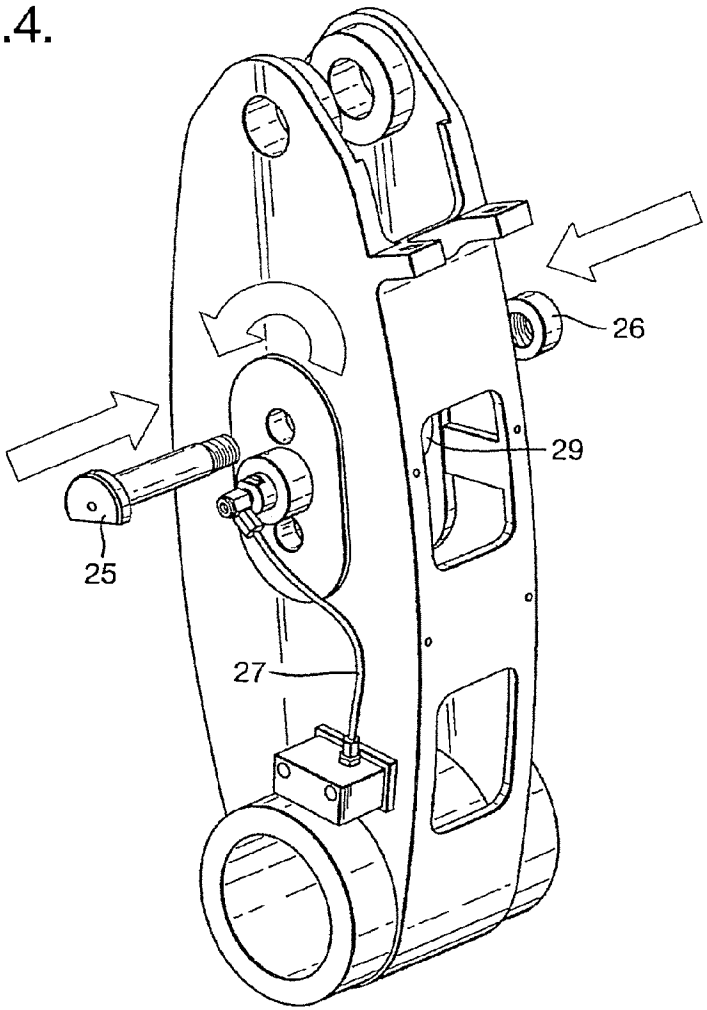
Fig.4.
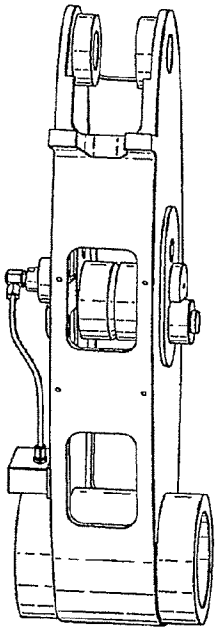
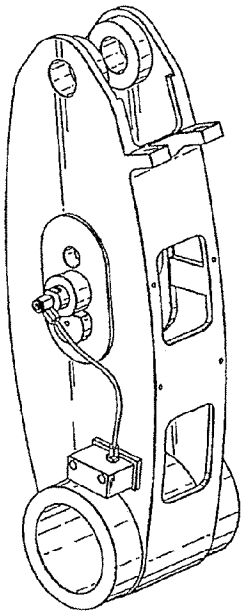

BODYMAKER

CROSS-REFERENCE TO RELATED APPLICATIONS

This application is the National Stage of International Application No. PCT/EP2008/065681, filed Nov. 17, 2008, which claims the benefit of EP Application No. 07122465.3, filed Dec. 6, 2007, the disclosures of which are incorporated herein by reference in their entirety.

TECHNICAL FIELD

This invention relates to a long stroke press or, as it is known in the can making industry, a bodymaker, for drawing hollow articles. It also relates to a bodymaker for ironing the side wall of a drawn metal cup to make a taller can and in particular to the forming of drawn and wall ironed ("DWI") can bodies of different heights from the same bodymaker.

BACKGROUND ART

In known bodymakers, cups are fed to the bodymaker and carried by a punch on the end of the ram, through a series of ironing dies to obtain the desired size and thickness of the can. Ultimately, the can body carried on the punch may contact a bottom forming tool so as to form a shape such as a dome on the base of the can. The ram is driven through a link at one end of a pivoted lever. The lever is connected to a driven crankshaft by a connecting rod and converts arcuate motion of the crankshaft into linear motion of the ram. Where the ram motion is horizontal, bearings in a cradle or frame are required to support the ram.

The height of the resultant can body is dictated predominantly by the stroke of the bodymaker. In order to make different can sizes, it is generally considered impractical to use a single machine and therefore it is customary to use different bodymakers and associated tooling for each different can size. The only possible known way of using a single machine for different can sizes would require use of a standard long stroke machine which operates at slow speed for tall cans. For shorter can sizes it is then necessary to rearrange the tooling and operate the same machine at the same stroke length and speed, which is slower than is usual for making shorter can sizes. Alternatively, the tall cans are simply cut down to the desired smaller can size. Clearly neither of these approaches is economically viable.

If a diameter and height change is needed, a ram having a smaller diameter than is conventional has been tried with the punch at the end of the ram changed for different can height and/or diameter. However the use of a smaller diameter ram for a long stroke machine means that the ram is likely to droop excessively on the return stroke. The large punch would therefore risk damaging tooling as it moves through the machine.

DISCLOSURE OF INVENTION

According to the present invention, there is provided a can bodymaker including a ram, a crankshaft, first and second (respectively "primary" and "secondary") connecting rods and a swing lever connecting the crankshaft to the ram, in which the primary connecting rod is rotatable about first or second pivot points on the swing lever, whereby altering the pivot point changes the stroke of the ram, without the need for change of the ram or requiring multiple change parts.

The ram of the invention operates horizontally and may be of standard size with a punch on the end of the ram matching the ram in size. Consequently, the ram does not droop unacceptably on the return stroke. Most importantly, the bodymaker of the present invention can be readily set up to have alternative stroke lengths for the ram by simply changing the pivot position of the primary connecting rod, perpendicular to the swing lever. The components therefore do not move as far for short strokes as is necessary for longer strokes. Also, there are no hydraulics involved in the change of stroke length in contrast with prior art such as JP H11-156598. Consequently there is no problem with speed loss when using a long stroke machine for producing shorter cans than is the case with prior art bodymakers. The machine speed is set for the long stroke position with maximum pivoting of the swing lever. In the present invention, moving the pivot point for shorter strokes results in less swing lever movement as well as shorter strokes so that the same machine can run faster than for the long stroke speed.

In one embodiment, the swing lever includes a sleeve which has holes for insertion of a pin to form the desired pivot point. These holes are eccentric so that the degree of rotation is controlled by the position of the pin.

In a preferred embodiment, the stroke length of the ram may be varied from 482.6 to 762 mm (19" to 30") in a single bodymaker with only minor change parts required. A more usual range of stroke lengths which limits any effect on machine dynamics and does not require additional change parts would be from 533.4 to 660.4 mm (21" to 26"). The most preferred range of stroke lengths may be achieved within a standard machine to convert from stroke lengths of 575 mm up to 660.4 mm (26"). All of these ranges include standard stroke lengths for producing wall ironed beverage cans on different bodymakers but clearly changes corresponding to the most preferred range (660.4–575 mm=85.4 mm) are possible by simply altering the pivot point of the swing lever. It is also apparent that stroke lengths within this range could be achieved if the desired can size required.

The bodymaker will generally be used in conjunction with can making apparatus such as discharge apparatus and trimmer apparatus, which may be adjusted for use with the dual-stroke bodymaker by a small datum change.

According to another aspect of the present invention, there is provided a method of forming different sizes of drawn and wall ironed cans from the same bodymaker, the method comprising:

providing a bodymaker which includes a ram, a crankshaft, first and second ("primary" and "secondary") connecting rods and a swing lever connecting the crankshaft to the ram;

connecting the primary connecting rod to a first position on the swing lever, rotating the primary connecting rod about a first pivot point on the swing lever, driving the swing lever to rotate by a first degree, and thereby converting the swing lever rotation into axial movement of the ram so as to move the ram by a first stroke length; or connecting the primary connecting rod to a second position on the swing lever, rotating the primary connecting rod about another pivot point on the swing lever, driving the swing lever to rotate by a second degree, and thereby converting the swing lever rotation into axial movement of the ram so as to move the ram by a second stroke length;

whereby altering the pivot point for the primary connecting rod changes the stroke of the ram.

Preferably, the swing lever includes a sleeve, which has holes for insertion of a locking pin to form the desired pivot point, and the method comprises connecting the primary connecting rod to the sleeve by a pivot pin, such that the primary connecting rod is rotatable about the sleeve; and locking the sleeve in a first position on the swing lever by a locking pin;

in which the pivot and locking pins are eccentric and rotation of the primary connecting rod is about a point between the pivot and locking pins.

BRIEF DESCRIPTION OF FIGURES IN THE DRAWINGS

A preferred embodiment of the invention will now be described, by way of example only, with reference to the drawings, in which:

FIG. 4 is a like view to FIG. 3, showing pin insertion;

MODE(S) FOR CARRYING OUT THE INVENTION

Figure 1:
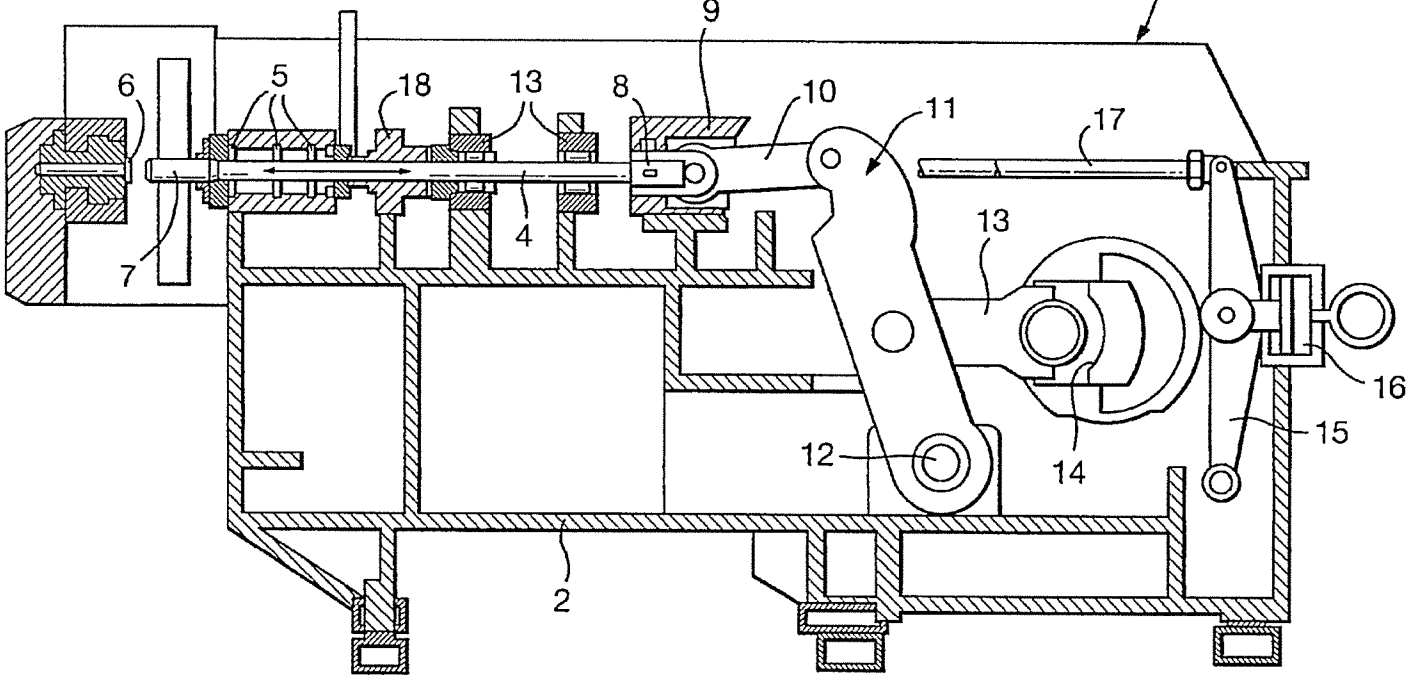
Fig.1. PRIOR ART
FIG. 1 is a diagrammatic sectional side view of a known bodymaker.

The bodymaker shown in FIG. 1 shows a long stroke press for making can bodies from a cup drawn from sheet metal. The press 1 comprises a frame 2, a pair of hydrostatic bearings and a ram 4 supported in the bearings for linear motion through a series of ironing dies 5 towards and away from a bottom (dome) forming tool 6. A punch 7 is mounted on the end of the ram nearest the bottom forming tool 6.

At the other end of the ram, there is a coupling 8 fixed to the ram. The coupling is supported on a slide 9. The coupling is operably connected by a drag link 10 to the top end of a swing lever 11 which pivots at the other end in a pivot 12 fixed to the frame 2. The lever is driven at its mid-point by a primary connecting rod 13, which is driven by a crank 14 for limited rotation about a pivot point in the swing lever 11.

A second action linkage comprising a second lever 15 is held against can profiles on the crank 14 by a buffer 16. The second lever 15 drives a pair of push rods 17 (one of pair shown) to drive a crosshead to actuate a blankholder 18. Cups are fed into the bodymaker just ahead of the blankholder position. It is clear from FIG. 1 that the back dead centre position of the ram is to the right of the blankholder 18.

As can be seen from FIG. 1, rotation of the crank is translated into linear movement of the ram by pivoting of the swing lever 11 about pivot 12 and by a link (secondary connecting rod) 10 and coupling 8. Even if a different size of can were to be formed from the same bodymaker, it has always been considered necessary to sacrifice machine speed by using the slowest speed as used for tall cans and either cut down the cans, or re-arrange the majority of the tooling and form smaller cans at the same, relatively slow speed. It is generally believed to be more sensible to have separate bodymakers each dedicated to a specific can size and operate each bodymaker at the fastest possible speed for that can size.

The inventors of the present application realised that by changing and/or controlling the point at which the swing lever is driven by the primary connecting rod, different amounts of linear movement are possible from the same ram without any need to change other parts of the bodymaker or peripheral apparatus. In particular, where the amount of change in stroke length (i.e. linear ram movement) is not great, such as between 575 mm and 660.4 mm (26"), at most only the position at which the swing lever is driven by the primary connecting rod and crankshaft needs to be changed.

Figure 2:
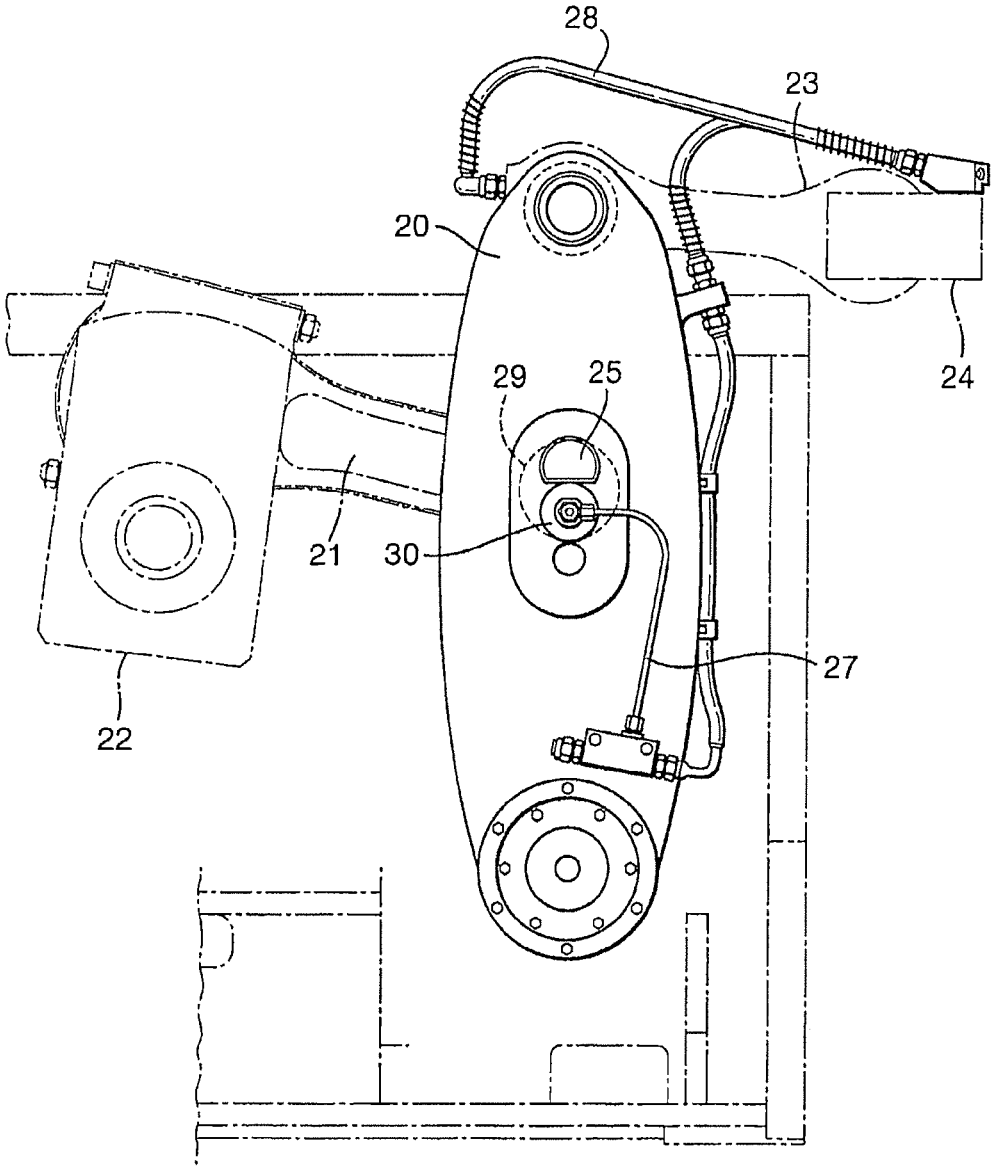
FIG. 2 is a face view of a swing lever of the invention, showing fluid lines, connecting rods and crankshaft.
Figure 3:
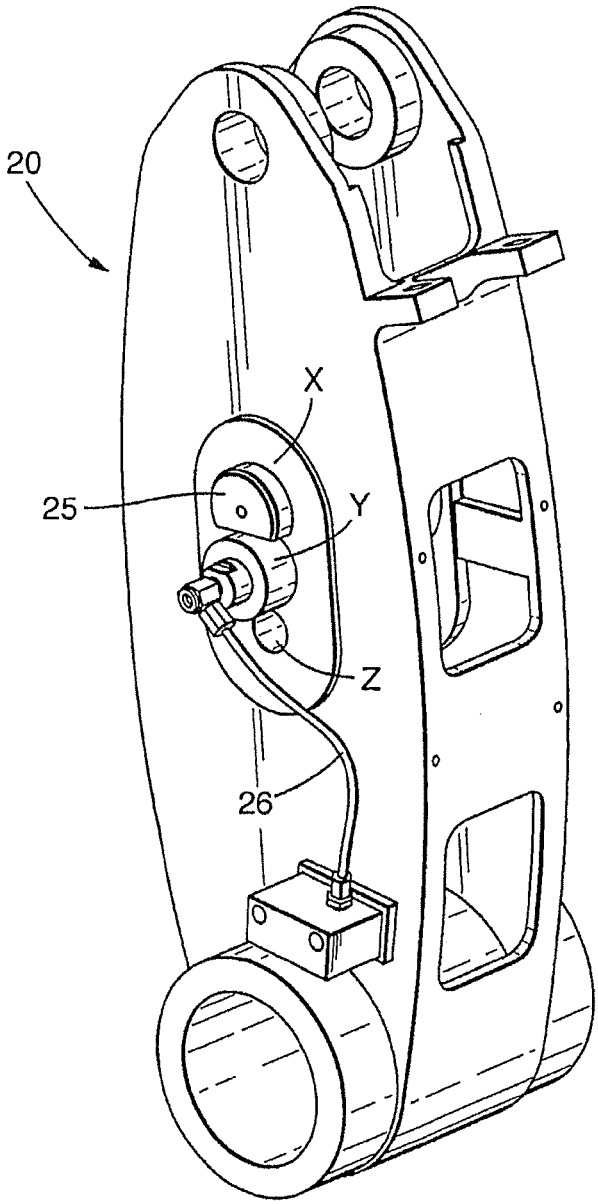
FIG. 3 is a perspective view of the swing lever of FIG. 2.

FIGS. 2 to 4 show a swing lever 20 of one example of the present invention, which allows a dual stroke length to be obtained from the same machine of 575 mm and 660.4 mm (26"). These figures correspond to FIG. 1 in that the swing lever is pivoted at its lower larger end where it is connected to the bodymaker frame (see FIG. 1, item 12) and at its smaller upper end to a secondary connecting rod 23. At its mid-point, the degree of rotation of the lever 20 is controlled by a primary connecting rod 21 which is driven by crank 22.

The secondary connecting rod 23, yoke slide 24 and ram centre line are best seen in FIG. 2 at the smaller upper end of the swing lever. Secondary connecting rod 23 and yoke slide 24 correspond to the drag link 10 and slide 9 of FIG. 1. Fluid supply line 27 supplies oil through the central connection to the primary connecting rod 21. Fluid supply line 28 supplies oil at its upper end to secondary connecting rod 23.

In the swing lever of the present invention as shown in FIGS. 2 to 4, locking holes X and Z are provided in the swing lever. Locking pin 25 is inserted in locking hole X in FIGS. 2 and 3. Within the swing lever in FIGS. 2 and 4, there can be seen the outline of a cylindrical sleeve 29. In common with the prior art swing lever, the sleeve is surrounded by the primary connecting rod.

In the prior art, the primary connecting rod rotates about a pivot pin in the centre of the sleeve. In the present invention, however, sleeve 29 has an eccentric hole Y through which the sleeve 29 is fixed via pivot pin 30 in the desired position within the swing lever. The second hole in sleeve 29 corresponds to the locking hole X or Z and the position of locking pin 25. The locking pin 25 in FIGS. 2 and 4 is through hole X. Thus actual rotation of the primary connecting rod 21 is about an axis between the locking pin 25 and pivot pin 30, which in this embodiment is the centre of the sleeve 29. Relative movement between the primary connecting rod and sleeve is allowed by a bush (not shown).

Figure 5:
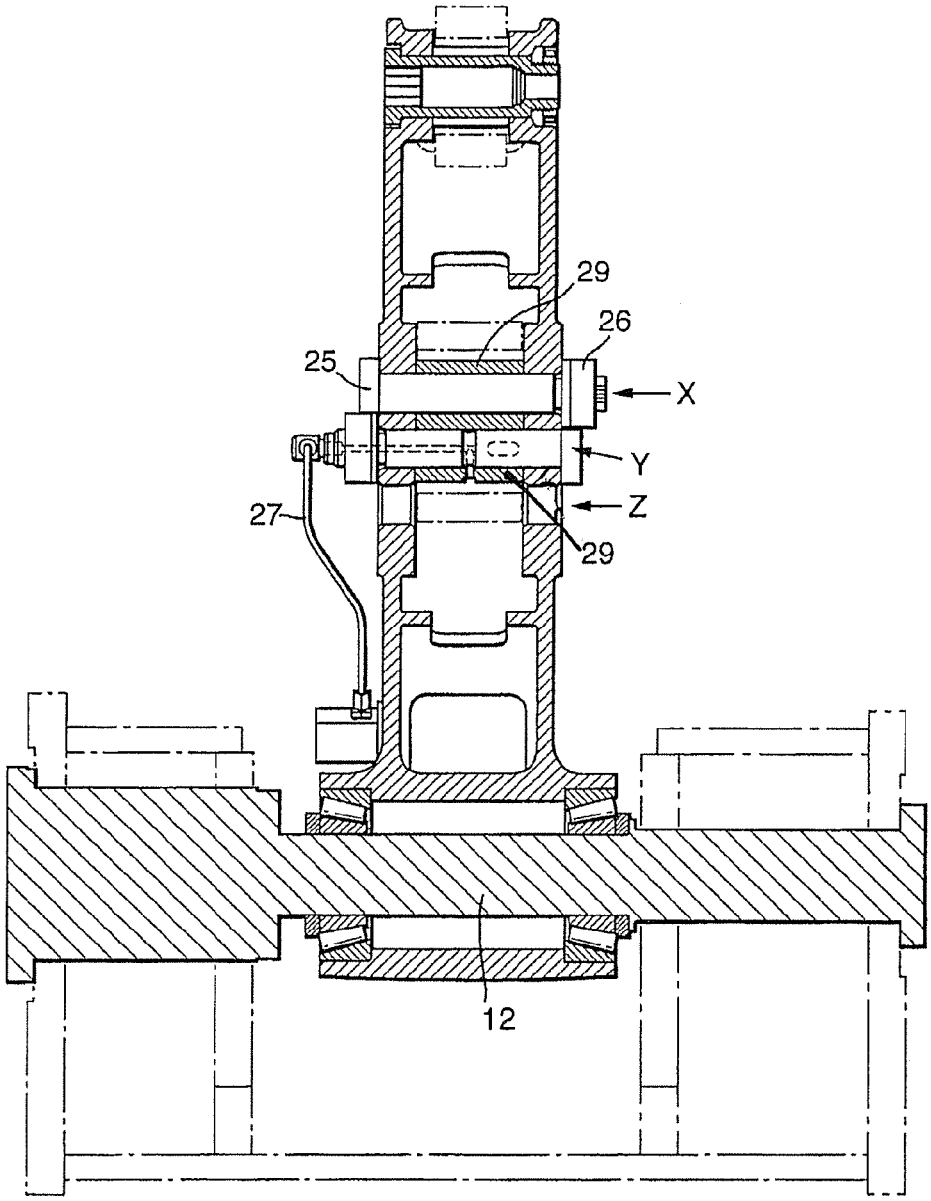
FIG. 5 is a side view of the swing lever of FIG. 2.

FIG. 5 is a side view of the swing lever in which the sleeve 29 is shown in side section with pin 25 in position X. Fluid supply line 27 to sleeve 29 and primary connecting rod 21 connects to pivot pin 30, axis Y. With reference to FIGS. 4 and 5, for changing the position of the pivot, pin 25 is removed from locking hole X, sleeve 29 is rotated about its pivot pin 30 within lever 20 by 180 degrees and the pin is then inserted in the other locking hole (Z in FIG. 5). Nut 26 is used to maintain the pin in position in the desired pivot hole. Clearly the sleeve and associated components need careful engineering to ensure that delivery of oil from fluid line 27 is not disrupted as the sleeve is rotated and pivot pin removed.

The swing lever is pivotable about the bodymaker frame in the same way as shown in FIG. 1 about pivot 12. However, the amount of swing lever rotation in the invention is not determined simply by the fact that the crankshaft and primary connecting rod rotation limit movement of the swing lever. In the present invention, the position of point A determines the degree of rotation of the swing lever when driven by crankshaft and primary connecting rod. As a result of the controlled swing lever rotation, the movement of the secondary connecting rod will also be changed. In turn, the stroke length (and back dead centre position) of the ram connected to yoke slide 24 is varied by the swing lever 20 rotation, the amount being directly dependent on the position of pin 25.

Figure 6:
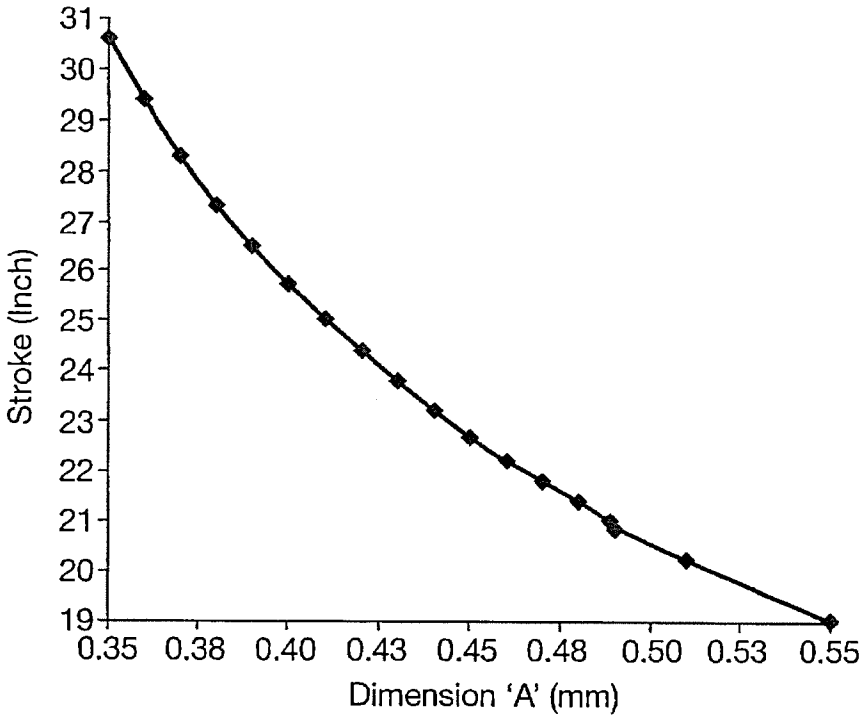
FIG. 6 is a graph showing the effect of varying the pivot point on the stroke length.
Figure 6:
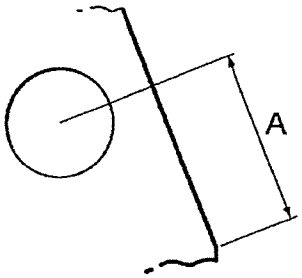

FIG. 6 is a graph of distance from the frame pivot point 12 up to the primary connecting rod pivot (x-axis, in millimeters) against machine stroke (y-axis, in inches). From the graph, it is clear that the swing lever of the present invention can be used to vary the stroke length in currently available machines from 482.6 to 762 mm (19" to 30"), with a change from about 533.4 to 660.4 mm (21" to 26") being fairly linear. Future bodymakers may, of course, be designed for stroke lengths beyond the limits of existing bodymakers at the date of filing. Minimum machine changes such are shown by the simple change of pin position within sleeve 29 are best achieved for stroke lengths of 575 mm up to 660.4 mm (22.64" to 26"). Some redesign of parts may be required to achieve the full range of stroke length change but these would still be more economic than the current requirement for a range of bodymakers each dedicated to a single specific can size.

In its simplest form, spacers may be used to adapt how the tooling is situated within the machine. For large changes in can height, there will be the normal changes of discharge apparatus, punch and a spacer to move the dome die for forming the base of the can.

The bodymaker of the present invention can also be used in conjunction with minor changes to the discharge datum for longer rams such as required for 16 oz cans. The datum change can be corrected for after discharge to the trimmer (trims the top of the drawn and wall ironed can) by moving the machine left or right, depending on appropriate layout. Such changes are, however, relatively minor and can be achieved within a short time frame with the use of simple spacers.

Figure 7:
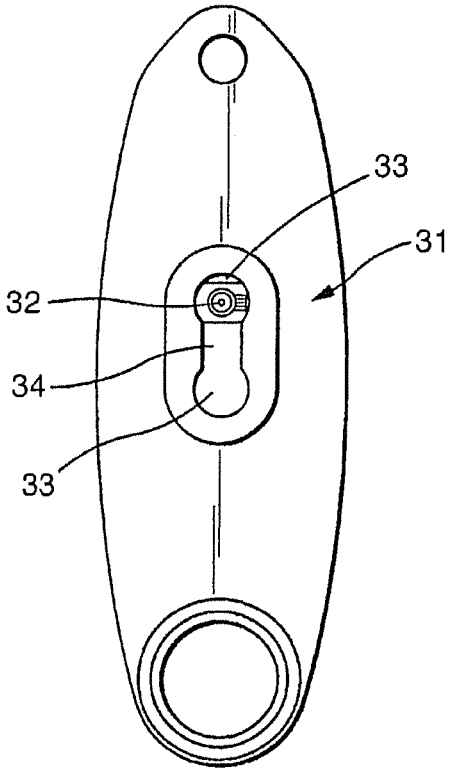
FIG. 7 is a schematic side view of an alternative embodiment of swing lever.

One alternative way of changing and/or controlling the point at which the swing lever is driven by the primary connecting rod without any need to change other parts of the bodymaker or peripheral apparatus is shown schematically in FIG. 7. In FIG. 7, the swing lever has a slot 31 into which a notched pin 32 is inserted to fix the desired position of the primary connecting rod. The swing lever slot has enlarged cylindrical parts 33 for locking the notched pin 32 (here both ends of the slot) when the pin is rotated with the notched part out of alignment with the narrower elongated part 34 of the swing lever slot.

To move the pin and primary connecting rod to a different position in the swing lever slot, the pin is rotated so that its notched part is in line with the elongated narrow part 34 of the slot. The pin is then slid to another position and locked by rotation out of alignment as before. Although the figure only shows two alternative pin positions, clearly more would be possible within the constraints of the swing lever dimensions. For example, clearance would also be required for pivoting of the primary connecting rod.

Another embodiment (not shown) moves the primary connecting rod to discrete pin positions along the swing lever. Here the entire primary connecting rod moves to a new pair of pins (fixed and pivot), again allowing space for the primary connecting rod to move within the swing lever. There could be multiple positions provided along the same swing lever, again within the constraints of swing lever dimensions.

Other methods and apparatus which change the pivot position for the primary connecting rod and thereby the stroke of the ram are possible within the scope of the invention, as set out in the claims.

The invention claimed is:

1. A can bodymaker including a ram, a crankshaft, a swing lever, a primary connecting rod that couples the crankshaft to the swing lever, and a secondary connecting rod that operatively couples the swing lever to the ram, the swing lever including a body and a sleeve, the body having holes for insertion of a locking pin and the body and sleeve connected by a pivot pin, the swing lever defining at least a first pivot axis when the sleeve is locked in a first position on the body by the locking pin and a second pivot axis when the sleeve is locked in a second position on the body by the locking pin, whereby the primary connecting rod is selectively rotatable about both the first and second pivot axes on the swing lever, such that when the primary connecting rod is rotatable about the first pivot axis the ram has a first stroke length and when the primary connecting rod is rotatable about the second pivot axis the ram has a second stroke length that is different than the first stroke length.

2. A bodymaker according to claim 1, in which the range of stroke lengths of the same ram is variable from 482.6 to 762 mm (19" to 30").

3. A bodymaker according to claim 1, in which the range of stroke lengths is variable from 533.4 to 660.4 mm (21" to 26").

4. A bodymaker according to claim 3, in which the range of stroke lengths is variable from 575 mm up to 660.4 mm (26").

5. A bodymaker and can making apparatus combination comprising:

a can bodymaker including a ram, a crankshaft, primary and secondary connecting rods, and a swing lever connecting the crankshaft to the ram, the swing lever being pivotal about a swing lever pivot axis, the swing lever defining an elongate slot having at least two enlarged portions separated by a narrow portion, the primary connecting rod being selectively rotatably coupled to the swing lever by a notched pin at first and second pivot points defined by the at least two enlarged portions of the elongate slot, such that altering the pivot point of the primary connecting rod on the swing lever from the first pivot point to the second pivot point changes the degree that the swing lever pivots about the swing lever pivot axis thereby changing the stroke of the ram; and a can making apparatus including a discharge apparatus and a trimmer apparatus, which is adjusted for use with the can bodymaker by a small datum change.

6. A method of forming different sizes of drawn and wall ironed cans from the same bodymaker, the bodymaker including a ram, a crankshaft, primary and secondary connecting rods, and a swing lever connecting the crankshaft to the ram, the swing lever including a body and a sleeve, the body having holes for insertion of a locking pin the method comprising:

connecting the sleeve to the body by a pivot pin, locking the sleeve in a first position on the body with the locking pin such that a first pivot axis is defined between the pivot pin and the locking pin, connecting the primary connecting rod to the swing lever such that the primary connecting rod is rotatable about the sleeve, rotating the primary connecting rod about the first pivot axis on the swing lever, driving the swing lever to rotate by a first degree so as to convert the swing lever rotation into axial movement of the ram such that the ram moves by a first stroke length; and changing the connection of the primary connecting rod to the swing lever such that the primary connecting rod is connected to the swing lever at a second pivot axis that is different than the first pivot axis, rotating the primary connecting rod about the second pivot axis on the swing lever, driving the swing lever to rotate by a second degree, so as to convert the swing lever rotation into axial movement of the ram such that the ram moves by a second stroke length that is different than the first stroke length.

7. A method according to claim 6, wherein the changing step comprises locking the sleeve in a second position that is different than the first position on the body with the locking pin such that the second pivot axis is defined between the pivot pin and the locking pin.

8. A can bodymaker comprising:

a swing lever pivotably coupled to a frame at a swing lever pivot, the swing lever having a body that defines a first locking hole and a second locking hole, a sleeve rotatably coupled to the body at a sleeve pivot axis that is located between the first and second locking holes, and a locking pin, the sleeve defining a pin receiving hole, the sleeve being configured to rotate about the sleeve pivot axis between a first position whereby the first locking hole and the pin receiving hole are aligned and receive the locking pin and a second position whereby the second locking hole and the pin receiving hole are aligned and receive the locking pin, the sleeve defining a first pivot axis when in the first position and a second pivot axis when in the second position;

a ram operatively coupled to the swing lever; and a primary connecting rod rotatably coupled to the sleeve such that when the sleeve is in the first position the primary connecting rod rotates about the first pivot axis and causes the ram to have a first stroke length, and when the sleeve is in the second position the primary connecting rod rotates about the second pivot axis and causes the ram to have a second stroke length that is different than the first stroke length.

9. The can bodymaker of claim 8, wherein the first pivot axis is located between the sleeve pivot axis and the first locking hole and the second pivot axis is located between the sleeve pivot axis and the second locking hole.

10. The can body maker of claim 8, wherein the sleeve defines an eccentric hole through which a pivot pin extends to couple the sleeve to the swing lever body.

11. The can bodymaker of claim 8, wherein the swing lever pivots a first degree about the swing lever pivot axis when the sleeve is in the first position and a second degree about the swing lever pivot axis when the sleeve is in the second position.

12. The can bodymaker of claim 8, further comprising a second connecting rod that operatively couples the swing lever to the ram.

13. The can bodymaker of claim 12, wherein the swing lever pivot axis is at a first end of the swing lever and the second connecting member is coupled to the swing lever at a second end of the swing lever that is opposite the first end.

14. The can bodymaker of claim 8, wherein the sleeve is disposed within the body.

* * * * *